United States Patent [19]

Staten

[11] Patent Number: 5,023,607

[45] Date of Patent: Jun. 11, 1991

[54] PEDESTRIAN CROSSING SAFETY APPARATUS

[76] Inventor: Roy G. Staten, 2275 Palm Ave. #79, San Diego, Calif. 92032

[21] Appl. No.: 541,326

[22] Filed: Jun. 21, 1990

[51] Int. Cl.[5] ..... G08G 1/00

[52] U.S. Cl. ..... 340/908.1; 40/546; 40/612

[58] Field of Search ..... 340/473, 908, 908.1, 340/944, 487; 40/546, 592, 610, 612; 116/63 P

[56] References Cited

U.S. PATENT DOCUMENTS

| | | | |
|---|---|---|---|
| 3,015,804 | 1/1962 | Nunn | 340/908.1 |
| 3,810,091 | 5/1974 | Hoover | 40/546 |
| 3,821,860 | 7/1974 | Patty | 340/908 X |
| 4,104,980 | 8/1978 | Toomey | 116/63 P |
| 4,543,905 | 10/1985 | McKenney | 340/908 X |
| 4,574,726 | 3/1986 | Sullivan | 40/592 X |
| 4,616,225 | 10/1986 | Woudenberg | 340/908 |
| 4,633,215 | 12/1986 | Anders et al. | 40/592 X |

FOREIGN PATENT DOCUMENTS

| | | | |
|---|---|---|---|
| 502442 | 11/1954 | Italy | 116/63 P |

*Primary Examiner*—Joseph A. Orsino
*Assistant Examiner*—B. R. Tumm
*Attorney, Agent, or Firm*—Leon Gilden

[57] ABSTRACT

Apparatus including an L-shaped handle mounting a battery pack at one end thereof and a selectively actuated flashing sign at an upper end thereof wherein the flashing sign includes a border of a first coloration contrasting to a central panel of a second coloration each coloration formed of a reflective material wherein the handle of the organization includes a reflective strip of a first coloration including a handle and a switch member. The organization may further include a joint member to permit inter-folding of the organization for ease of transport and storage.

8 Claims, 4 Drawing Sheets

PEDESTRIAN CROSSING SAFETY APPARATUS

BACKGROUND OF THE INVENTION

1. Field of the Invention

The field of the invention relates to signal apparatus, and more particularly pertains to a new and improved pedestrian crossing safety apparatus wherein the same is arranged for directing attention to arrest movement of motor vehicles permitting pedestrians to cross at designated intersections.

2. Description of the Prior Art

At various intersections particularly intersections relating to passage of pedestrians such as school children and the like, crossing guards are frequently at a disadvantage in directing attention to a pedestrian crossing environment. The instant invention attempts to overcome deficiencies of the prior art by providing a signal arrangement particularly arranged to direct attention to a pedestrian crossing and enhance safety of the pedestrian crossing environment.

Examples of the prior art signal apparatus may be found in U.S. Pat. No. 4,633,215 to ANDERS et al wherein a signal member is positioned for mounting upon a vehicular roof and the like with a flashing light mounted at a corner thereof to indicate a distress situation.

U.S. Pat. No. 4,751,494 to CROTWELL sets forth a lighted sign and includes a flasher arrangement with legs for mounting upon a vehicle and the like with electrical association to a cigarette lighter organization of an associated vehicle.

U.S. Pat. No. 4,574,726 to SULLIVAN sets forth a portable distress signal apparatus utilizing a sleeve mounted to a staff.

U.S. Pat. No. 4,754,565 to COX sets forth a distress sign arranged for placement on an upper edge of a vertically movable window such as utilized in a motor vehicle by use of a clip arrangement.

As such, it may be appreciated that there continues to be a need for a new and improved pedestrian crossing signal apparatus as set forth by the instant invention which addresses both the problems of ease of use as well as effectiveness in construction and in this respect, the instant invention substantially fulfills this need.

SUMMARY OF THE INVENTION

In view of the foregoing disadvantages inherent in the known types of signal apparatus present in the prior art, the present invention provides a new and improved pedestrian crossing safety apparatus wherein the same utilizes a readily transportable and selectively positionable self contained signal apparatus to effect notice to motor vehicle operators of a pedestrian crossing. As such, the general purpose of the present invention, which will be described subsequently in greater detail, is to provide a new and improved pedestrian crossing safety apparatus which has all the advantages of the prior art signal apparatus and none of the disadvantages.

To attain this, the pedestrian crossing safety apparatus of the instant invention includes apparatus including an L-shaped handle mounting a battery pack at one end thereof and a selectively actuated flashing sign at an upper end thereof wherein the flashing sign includes a border of a first coloration contrasting to a central panel of a second coloration each coloration formed of a reflective material wherein the handle of the organization includes a reflective strip of a first coloration including a handle and a switch member. The organization may further include a joint member to permit interfolding of the organization for ease of transport and storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pedestrian crossing safety apparatus which has all the advantages of the prior art signal apparatus and none of the disadvantages.

It is another object of the present invention to provide a new and improved pedestrian crossing safety apparatus which may be easily and efficiently manufactured and marketed.

It is a further object of the present invention to provide a new and improved pedestrian crossing safety apparatus which is of a durable and reliable construction.

An even further object of the present invention is to provide a new and improved pedestrian crossing safety apparatus which is susceptible of a low cost of manufacture with regard to both materials and labor, and which accordingly is then susceptible of low prices of sale to the consuming public, thereby making such pedestrian crossing safety apparatus economically available to the buying public.

Still yet another object of the present invention is to provide a new and improved pedestrian crossing safety apparatus which provides in the apparatuses and methods of the prior art some of the advantages thereof, while simultaneously overcoming some of the disadvantages normally associated therewith.

Still another object of the present invention is to provide a new and improved pedestrian crossing safety apparatus which may be compactly stored when not being utilized.

Yet another object of the present invention is to provide a new and improved pedestrian crossing safety apparatus wherein the same sets forth structure to arrange a self contained signal apparatus for transport and selective positioning relative to a pedestrian crossing environment.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
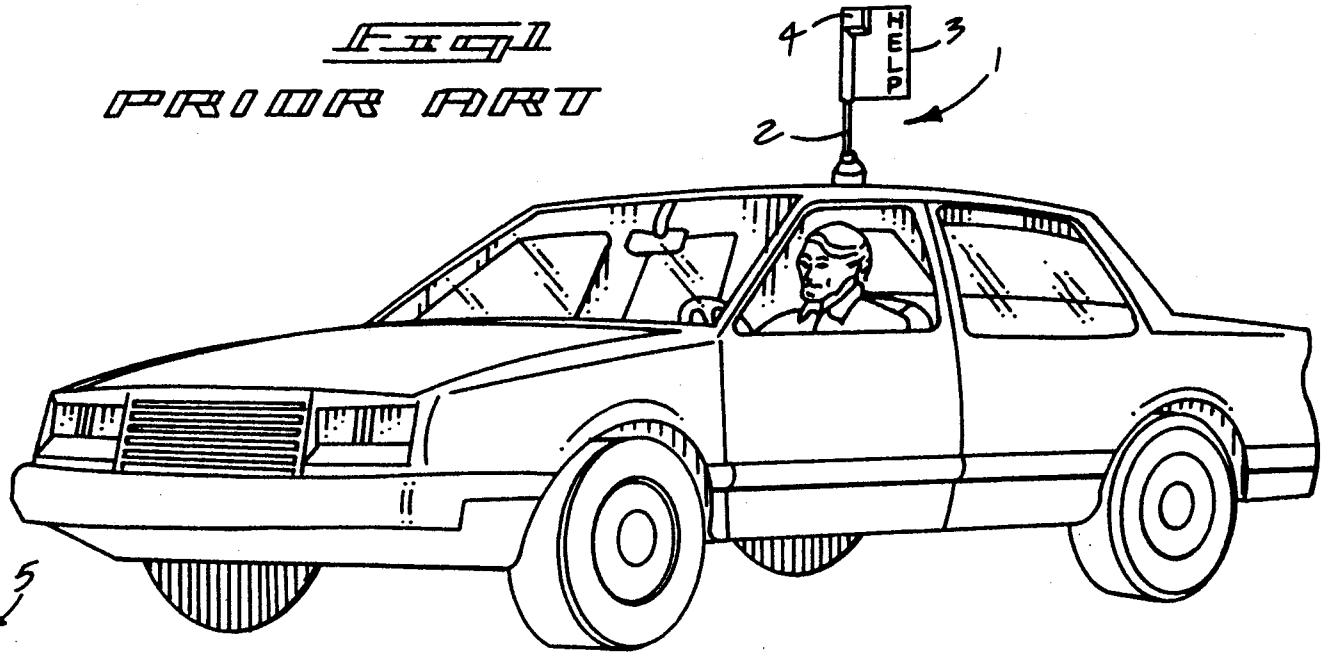
FIG. 1 PRIOR ART
FIG. 1 is an isometric illustration of a prior art signal apparatus.

With reference now to the drawings, and in particular to FIGS. 1 to 8 thereof, a new and improved pedestrian crossing safety apparatus embodying the principles and concepts of the present invention and generally designated by the reference numeral 10 will be described.

Figure 2:
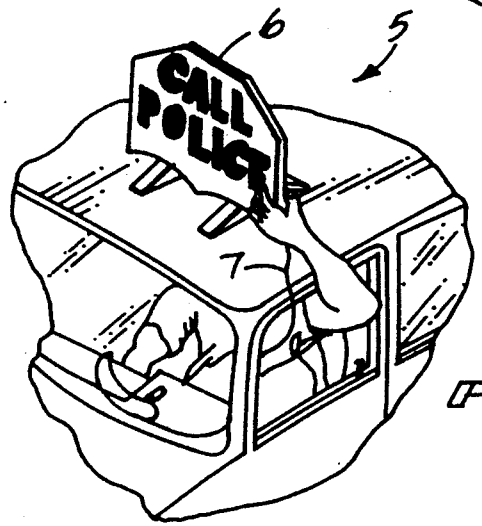
FIG. 2 PRIOR ART
FIG. 2 is an isometric illustration of a further prior art signal apparatus.
Figure 3:
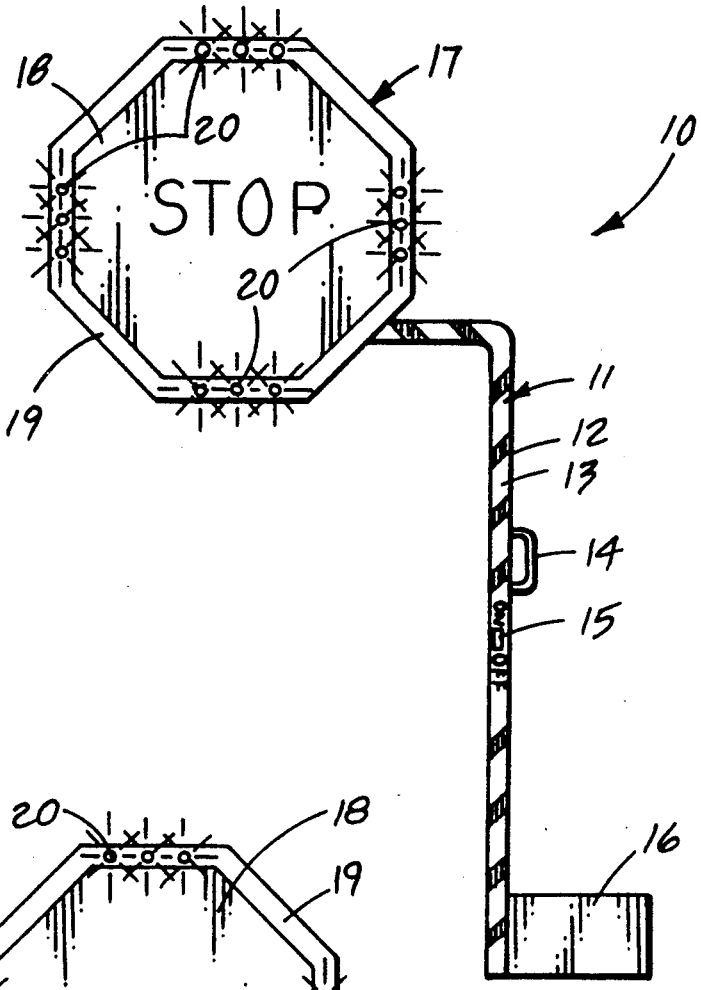
FIG. 3 is an orthographic frontal view taken in elevation of the instant invention.
Figure 4:
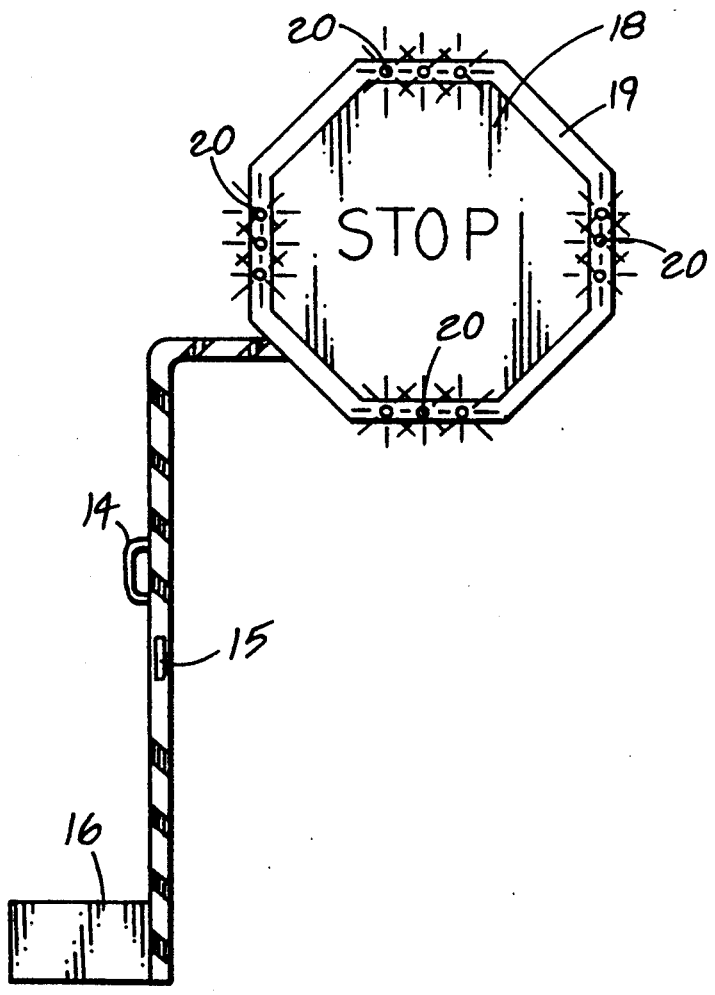
FIG. 4 is an orthographic rear view taken in elevation of the instant invention.
Figure 5:
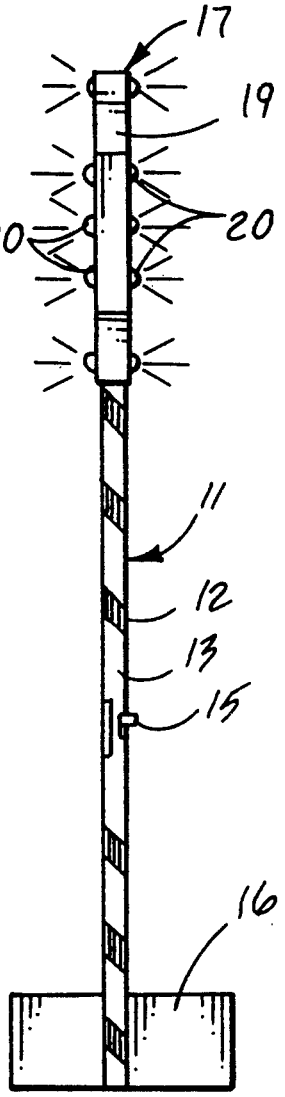
FIG. 5 is an orthographic side view taken in elevation of the instant invention.
Figure 6:
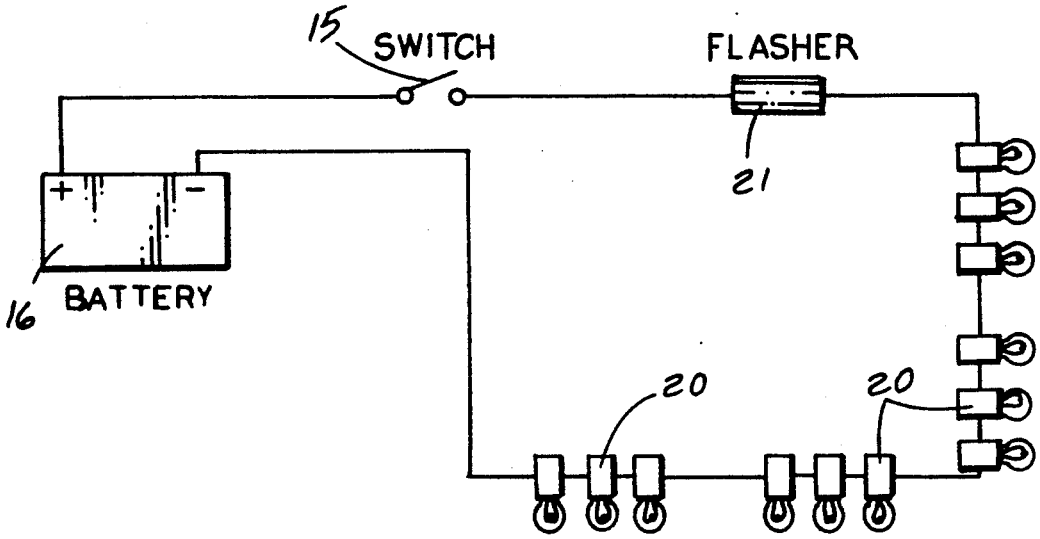
FIG. 6 is a diagramatic illustration of an electrical circuit utilized by the instant invention.

FIG. 1 illustrates a prior art signal structure 1 wherein a support post 2 is telescopingly received within a sign 3 utilizing a flasher unit 4 to direct attention to the sign organization. FIG. 2 illustrates the use of a flashing sign structure 6 utilizing electrical association by a cord structure 7 to a cigarette lighter of an associated motor vehicle.

More specifically, the pedestrian crossing safety apparatus 10 of the instant invention essentially comprises, an L-shaped support shaft 11 including an alternating first reflective stripe 12 defined by a first coloration such as a reflective red or yellow with a second reflective stripe 13 of a second contrasting coloration such as white wherein the first and second stripes are helically wound about the support shaft 11. A U-shaped handle 14 is integrally and orthogonally mounted medially of a vertical shaft portion of the handle 11 adjacent an on/-off switch 15 positioned adjacent the handle to permit convenient manipulation of the switch during use. A battery storage container 16 is mounted at a lower terminal end of the vertical extent of the support shaft 11 and provides a support base as well as a counter balance to a sign member 17 mounted at a remote terminal end of the horizontal extent of the support shaft 11. The sign member 17 includes a reflective sign first coloration 18 such as a red or yellow coloration with a reflective second coloration 19 defined as a continuous border about the first coloration 18.

The sign is formed of an octagonal configuration conformity with universally accepted stop sign configurations with contrasting letters positioned medially of the reflective first coloration 18 to indicate the word "Stop".

Figure 7:
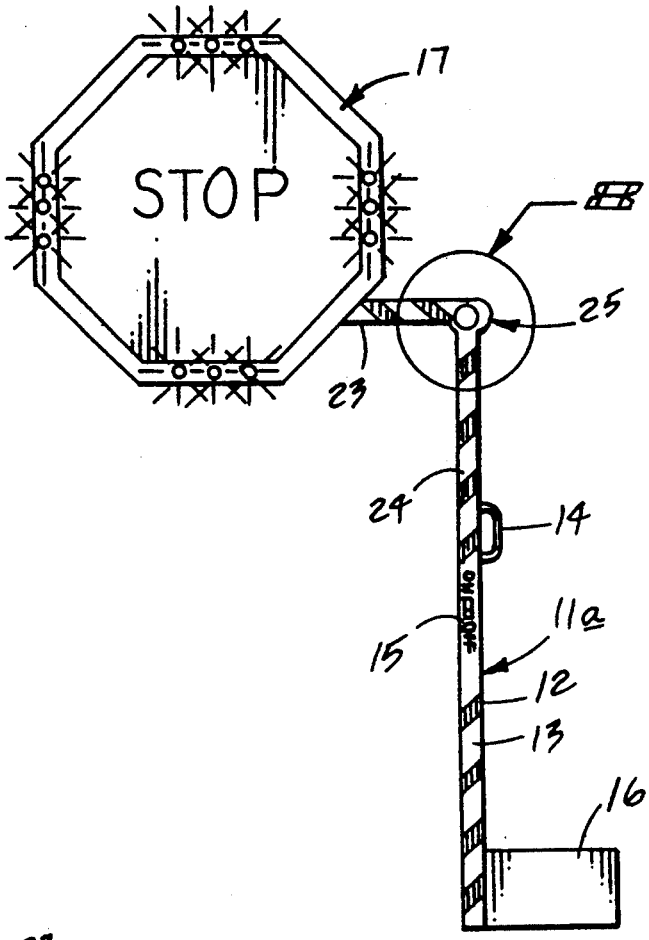
FIG. 7 is an isometric illustration of a modified handle structure utilized by the instant invention.
Figure 8B:
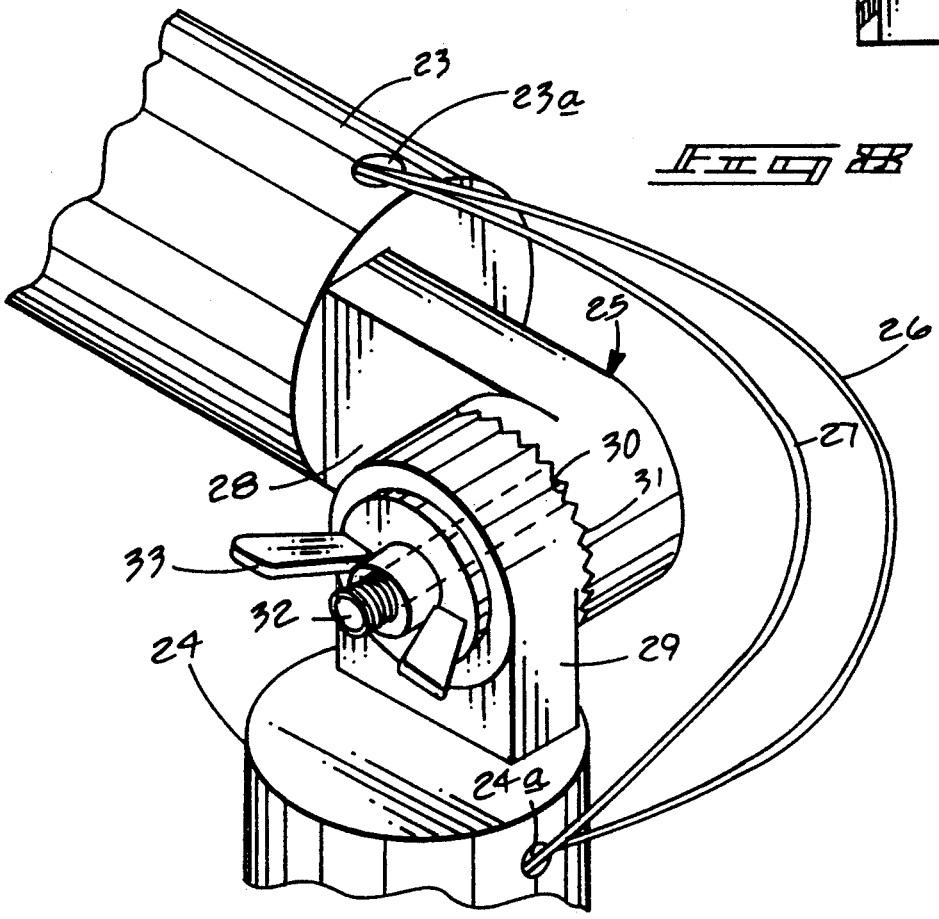
FIG. 8 is an isometric illustration somewhat enlarged of section 8 as set forth in FIG. 7.

A series of 4 flashing light sets 20 are mounted at respective upper, lower, right side, and left side portions of the border 19 and cooperate with a flasher unit 21 to effect flashing of the bulbs of the light sets 20. Reference to FIG. 7 and 8 illustrates a modified support shaft **11*a* of the organization wherein the support shaft 11*a* includes a horizontal leg 23 pivotally mounted to a vertical leg 24 wherein the battery storage container 16 is mounted at a lower terminal end of the vertical leg 24 while the sign member 17 is mounted at a free terminal end of the horizontal leg 23. A selectively lockable joint member 25 is mounted at an intersection defined by the horizontal and vertical legs 23 and 24 respectively wherein a horizontal leg plate 28 projects longitudinally of the horizontal leg 23 while a vertical leg plate 29 projects longitudinally of the vertical leg 24 wherein the horizontal and vertical leg plates 28 and 29 respectively are pivotally mounted relative to one another and selectively locked together by a joint member 25. The horizontal leg 23 includes a horizontal leg opening 23*a* while the vertical leg 24 includes a vertical leg opening 24*a* to direct a first and second electrical connective wire 26 and 27 from the vertical leg to the horizontal leg to effect electrical communication between the battery container 16 including a conventional storage battery therewithin in electrical communication with the sign member 17 through the switch 15 in a manner as set forth in FIG. 6 for example. The first and second electrical wires 26 and 27 define a length between the horizontal and vertical leg openings 23*a* and 24*a* of an extent greater than that defined by the respective horizontal and vertical leg plate 28 and 29 to permit accommodation of rotation of the horizontal leg 23 relative to the vertical leg 24 during pivotment of the horizontal leg 23 relative to the vertical leg 24** for storage and transport of the organization.

The joint member 25 includes a series of first radial serrated teeth 30 formed on the horizontal leg plate 28 including a threaded boss 32 orthogonally and integrally mounted coaxially of the first radial serrated teeth 30 on the horizontal leg plate 28. A series of second radial serrated teeth 31 are positioned in confronting relationship to the first radial serrated teeth 30 wherein the second radial serrated teeth 31 are mounted on the vertical leg plate 29 with a securement fastener 33 securable to the threaded boss 32 to sandwich the vertical leg plate 29 between the securement fastener 33 and the horizontal leg plate 28.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pedestrian crossing safety apparatus comprising, an L-shaped support shaft, the L-shaped support shaft including an alternating first reflective spiral coloration stripe coextensively directed about the L-shaped support shaft defining a second reflective coloration stripe of a contrasting coloration relative to the first coloration, and the L-shaped support shaft including a horizontal shaft and a vertical shaft, and a battery storage container mounted to the vertical shaft and a sign member mounted to the horizontal shaft with a light switch member mounted within the vertical shaft, light means mounted about the sign member to effect selective flashing of the light means upon actuation of the switch member, and wherein the sign member includes a reflective first sign coloration defining a central panel of the sign member with the sign member including a forward and rear central panel of identical configuration with each said central panel including a stop indicia designation within the central panel, and each said central panel including a continuous border including a forward border surface positioned about the forward central panel and a rear border surface positioned about the rear central panel with said border including a second sign coloration contrasting the first sign coloration with the light means positioned within the second sign coloration of the border to include a series of four flashing light sets mounted on the rear border surface about the sign member and the light means further including a further series of four flashing light sets mounted on the forward border surface of the sign member.

2. Apparatus as set forth in claim 1 wherein the four flashing light sets mounted on the front and the rear border surfaces and of the sign member are mounted upon respective upper, lower, right side, and left side borders of each said respective forward and rear border surface of the sign member.

3. Apparatus as set forth in claim 2 including a flasher unit mounted in electrical communication with the battery storage container, the switch member, and the light means including the flashing light sets.

4. Apparatus as set forth in claim 3 including a U-shaped handle integrally and orthogonally mounted medially adjacent the light switch member on the vertical support shaft.

5. Apparatus as set forth in claim 4 wherein the sign member is mounted in alignment integrally to a free end, of the horizontal support shaft and the battery storage container is mounted at a lower terminal end of the vertical support shaft wherein the battery storage container effects counter balance to the sign member and provides a support base for positioning the apparatus on a support surface.

6. Apparatus as set forth in claim 5 wherein the vertical support shaft and the horizontal support shaft are pivotally mounted relative to one another by a joint member, the joint member permitting selective locking engagement of the vertical support shaft to the horizontal support shaft.

7. Apparatus as set forth in claim 6 wherein the horizontal support shaft includes a horizontal leg plate and the vertical support shaft includes a vertical leg plate, the horizontal leg plate including a first radial array of serrated teeth and the vertical leg plate includes a complementarily arranged array of second radial serrated teeth mounted on the vertical leg plate cooperative with the first radial teeth to effect locking inter-engagement of the horizontal leg plate to the vertical leg plate, and the horizontal leg plate including a threaded boss integrally and orthogonally mounted coaxially of the first radial serrated teeth and directed coaxially through the second radial serrated teeth and through the vertical leg plate with a securement fastener to sandwich and secure the vertical leg plate between the horizontal leg plate and the securement fastener.

8. Apparatus as set forth in claim 7 wherein the horizontal support shaft includes a horizontal shaft opening and the vertical support shaft includes a vertical shaft opening with a first and second electical conductive wire directed through the horizontal shaft opening from the sign member directed about the joint member and into the vertical support shaft through the vertical shaft opening with the first and the second conductive wires defined by a predetermined length greater than a total length defined by a horizontal leg plate length and a vertical leg plate length to accommodate rotation of the horizontal shaft relative to the vertical shaft.

* * * * *